US012798741B2

(12) United States Patent
Li et al.

(10) Patent No.: US 12,798,741 B2
(45) Date of Patent: Nov. 17, 2026

(54) BIOMIMETIC UNDERWATER VEHICLE

(71) Applicant: WESTLAKE UNIVERSITY, Hangzhou (CN)

(72) Inventors: Wei Li, Hangzhou (CN); Bing Luo, Hangzhou (CN); Weicheng Cui, Hangzhou (CN)

(73) Assignee: WESTLAKE UNIVERSITY, Hangzhou (CN)

( * ) Notice: Subject to any disclaimer, the term of this patent is extended or adjusted under 35 U.S.C. 154(b) by 291 days.

(21) Appl. No.: 18/692,232

(22) PCT Filed: Sep. 14, 2021

(86) PCT No.: PCT/CN2021/118324
§ 371 (c)(1),
(2) Date: Mar. 14, 2024

(87) PCT Pub. No.: WO2023/039724
PCT Pub. Date: Mar. 23, 2023

(65) Prior Publication Data
US 2024/0383592 A1 Nov. 21, 2024

(51) Int. Cl.
*B63G 8/08* (2006.01)

(52) U.S. Cl.
CPC ..... *B63G 8/08* (2013.01)

(58) Field of Classification Search
CPC .. B63G 8/08; B63C 11/52; B63H 1/36; B63H 25/14
See application file for complete search history.

(56) References Cited

U.S. PATENT DOCUMENTS

2019/0135393 A1* 5/2019 Pieterkosky ..... B63B 35/44

FOREIGN PATENT DOCUMENTS

CN 102815388 A 12/2012
CN 106143851 A 11/2016
(Continued)

*Primary Examiner* — Sheetal R Paulson
(74) *Attorney, Agent, or Firm* — The Sun IP Law

(57) ABSTRACT

Embodiments of the present disclosure provide a biomimetic underwater vehicle which is mainly used in water, comprising a head portion and a body portion, wherein the head portion comprises a first housing, a motor portion is provided in the first housing, the motor portion comprises a plurality of motor assemblies; the body portion comprises a second housing, and a plurality of rotation joints corresponding to the plurality of motor assemblies are provided in the second housing; the plurality of rotation joints are sequentially connected along the length direction of the biomimetic underwater vehicle, and the rotation joint at the most downstream is connected to a tail portion, and each of the motor assemblies is connected to the corresponding rotation joint via two pull ropes and drives the rotation joint to move, and the two pull ropes are located on two sides of the body portion respectively. According to the embodiments of the present disclosure, by the corresponding arrangements of the motors located at the head portion and the rotation joints located in the middle and the transmission manner of multiple joints, on the one hand, the inertia of movement of the tail portion of the biomimetic underwater vehicle is reduced, and on the other hand, the center of gravity of the whole is moved forward so as to reduce the swinging movement of the head portion during driving of the biomimetic underwater vehicle, thereby achieving a flexible biomimetic effect and improving the propulsive performance of the biomimetic underwater vehicle.

7 Claims, 6 Drawing Sheets

(56) References Cited

FOREIGN PATENT DOCUMENTS

| | | | | |
|---|---|---|---|---|
| CN | 106697240 | A | 5/2017 | |
| CN | 109110095 | A | 1/2019 | |
| CN | 110937092 | A | 3/2020 | |
| CN | 214165269 | U | 9/2021 | |
| GB | 126231 | A | 5/1919 | |
| WO | WO-2018006613 | A1 * | 1/2018 | ..... B25J 11/00 |

* cited by examiner

BIOMIMETIC UNDERWATER VEHICLE

TECHNICAL FIELD

The present disclosure relates to the field of underwater vehicle devices that are mainly used in water, and in particular, relates to a biomimetic underwater vehicle.

BACKGROUND

In existing structures for underwater vehicles, often a driving device and a movement device cannot be controlled in a coordination manner, such that the underwater vehicle cannot achieve complicated movement or swing of fish, for example.

SUMMARY

An object of embodiments of the present disclosure is to provide a biomimetic underwater vehicle, to solve the problem that a driving device and a movement device cannot be controlled in a coordination manner in the prior art.

In order to solve the technical problem, embodiments of the present disclosure adopt the following technical solutions:

A biomimetic underwater vehicle, comprising a head portion and a body portion, wherein the head portion comprises a first housing, a motor portion is provided in the first housing, the motor portion comprises a plurality of motor assemblies; the body portion comprises a second housing, and a plurality of rotation joints corresponding to the plurality of motor assemblies are provided in the second housing; the plurality of rotation joints are sequentially connected along the length direction of the biomimetic underwater vehicle, and the rotation joint at the most downstream is connected to a tail portion, and each of the motor assemblies is connected to the corresponding rotation joint via two pull ropes and drives the rotation joint to move, and the two pull ropes are located on two sides of the body portion respectively.

In some embodiments, each motor assembly comprises a motor, a cable reel is sleeved on an output shaft of the motor, a first end of each of the two pull ropes is sleeved on the cable reel, and a second end of each of the two pull ropes is connected to the corresponding rotation joint.

In some embodiments, a protrusion portion is provided on an end face of an output side of the motor, a first connecting hole and a second connecting hole are provided on the protrusion portion, and the second ends of the two pull ropes respectively pass through the first connecting hole and the second connecting hole and are connected to the corresponding rotation joint.

In some embodiments, each of the rotation joints comprises a first base and a second base which are both U-shaped, wherein the first base and the second base are assembled with each other to form a base portion, a long edge located on one side of the first base and a long edge located on the same side of the second base are assembled with each other to form a first bearing, and a long edge located on the other side of the first base and a long edge located on the same side of the second base are assembled with each other to form a second bearing, wherein the first bearing and the second bearing are provided opposite to each other, and a joint rotation shaft is provided between the first bearing and the second bearing, and the joint rotation shaft rotates between the first bearing and the second bearing.

In some embodiments, the second ends of the pull ropes are sleeved on the joint rotation shaft.

In some embodiments, a joint connecting member is sleeved on the joint rotation shaft, and the joint connecting member is used for connecting to an adjacent rotation joint located downstream or connecting to the tail portion.

In some embodiments, a first pull rope restraint portion and a second pull rope restraint portion are respectively provided on short edges of the first base and the second base, the first pull rope restraint portion and the second pull rope restraint portion respectively protrude from end faces of the first base and the second base, and each of the first pull rope restraint portion and the second pull rope restraint portion is provided with a plurality of through holes, the through holes being used for fixing or restraining the pull ropes.

In some embodiments, at least one through hole is provided on each of the short edges of the first base and the second base, and the through hole is used for fixing or restraining the pull ropes.

In some embodiments, each of the pull ropes comprises a cable tube and a cable, wherein a first cable tube cap and a second cable tube cap are respectively arranged at two ends of the cable tube, the cable passes through the cable tube and freely moves in the cable tube, and the first cable tube cap and the second cable tube cap are fixed in specified through holes.

In some embodiments, the number of the motor assemblies or the rotation joints is three.

Compared with the prior art, according to the embodiments of the present disclosure, by the corresponding arrangements of the motors located at the head portion and the rotation joints located in the middle and the transmission manner of multiple joints, on the one hand, the inertia of movement of the tail portion of the biomimetic underwater vehicle is reduced, and on the other hand, the center of gravity of the whole is moved forward so as to reduce the swinging movement of the head portion during driving of the biomimetic underwater vehicle, thereby achieving a flexible biomimetic effect and improving the propulsive performance of the biomimetic underwater vehicle.

BRIEF DESCRIPTION OF THE DRAWINGS

In order to describe the technical solutions in the embodiments of the present disclosure or in the prior art more clearly, hereinafter, accompanying drawings requiring to be used for describing the embodiments or the prior art are introduced briefly. Apparently, the accompanying drawings in the following description merely relate to some embodiments disclosed in the present disclosure, and for a person of ordinary skill in the art, other accompanying drawings can also be obtained according to these accompanying drawings without involving any inventive effort.

Figure 1:
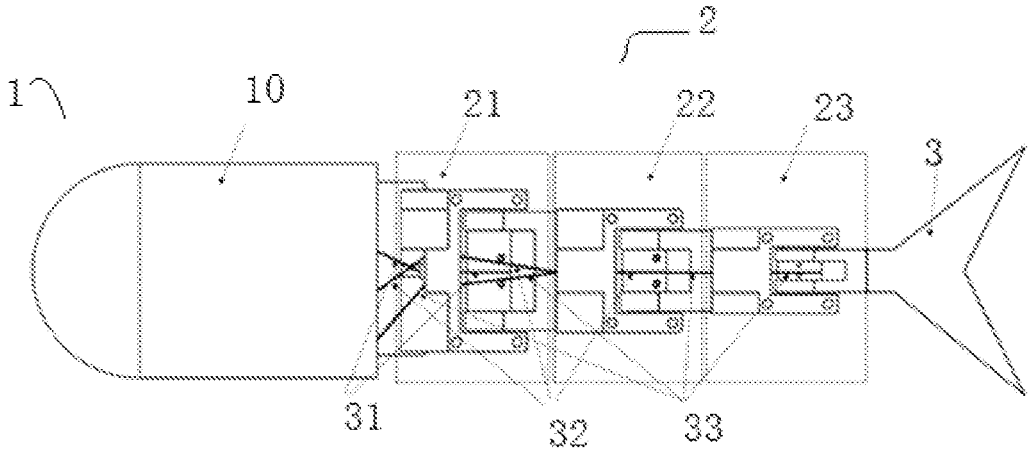
FIG. 1 is a schematic structural diagram of a biomimetic underwater vehicle according to embodiments of the present disclosure.

Reference signs:

1—Head portion; 11—First motor assembly; 12—Second motor assembly; 13—Third motor assembly; 131—Third motor; 132—Third cable reel; 133—First connecting hole; 134—Second connecting hole; 135—Protrusion portion; 2—Body portion; 21—First rotation joint; 211—First base; 212—Second base; 213—First bearing 214—Second bearing; 215—First joint rotation shaft; 216—First joint connecting member; 217—First pull rope restraint portion; 218—Second pull rope restraint portion; 22—Second rotation joint; 221—Third base; 222—Fourth base; 223—Third bearing; 224—Fourth bearing; 225—Second joint rotation shaft; 226—Second joint connecting member; 227—Third pull rope restraint portion; 228—Fourth pull rope restraint portion; 23—Third rotation joint; 231—Fifth base; 232—Sixth base; 233—Fifth bearing; 234—Sixth bearing; 235—Third joint rotation shaft; 236—Third joint connecting member; 3—Tail portion; 31—First pull rope; 32—Second pull rope; 33—Third pull rope; 41—First fixing hole; 42—First restraint hole; 43—Second restraint hole; 44—Second fixing hole; 45—Third restraint hole; 46—Third fixing hole.

DETAILED DESCRIPTION OF THE EMBODIMENTS

Various solutions and features of the present disclosure are described herein with reference to the accompanying drawings.

It will be appreciated that various modifications can be made to the embodiments as applied herein. Accordingly, the description should not be construed as limiting but merely as exemplifications of the embodiments. A person skilled in the art would have conceived of other modifications within the scope and spirit of the present disclosure.

The accompanying drawings, which are incorporated in the description and constitute a part of the description, illustrate embodiments of the present disclosure, and together with a general description of the present disclosure given above and the detailed description of the embodiments given below, serve to explain the principle of the present disclosure.

These and other features of the present disclosure will become apparent from the following description of preferred forms of embodiment given as non-limiting examples with reference to the accompanying drawings.

It should also be understood that while the present disclosure has been described with reference to specific examples, a person skilled in the art would be able to conclusively implement many other equivalent forms of the present disclosure having the features of the claims and thus all being within the scope of protection defined thereby.

The above and other aspects, features, and advantages of the present disclosure will become more apparent in view of the following detailed description when taken in conjunction with the accompanying drawings.

Hereinafter, specific embodiments of the present disclosure are described with reference to the accompanying drawings. However, it should be understood that the embodiments as applied are merely examples of the present disclosure, which may be implemented in various ways. Well-known and/or duplicate functions and structures have not been described in detail to avoid unnecessary or redundant details which obscure the present disclosure. Therefore, specific structural and functional details as applied herein are not intended for limiting, but merely as a basis and a representative basis for the claims and for teaching a person skilled in the art to diversely use the present disclosure in substantially any suitable detailed structure.

The description may use phrases "in one embodiment", "in another embodiment", "in yet another embodiment", or "in other embodiments", which may each refer to one or more of the same or different embodiments according to the present disclosure.

Figure 2:
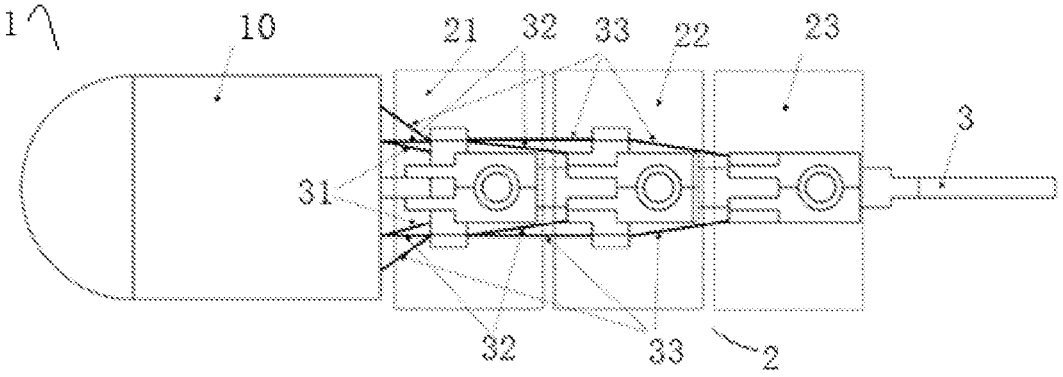
FIG. 2 is a schematic structural diagram of a biomimetic underwater vehicle according to embodiments of the present disclosure.
Figure 3:
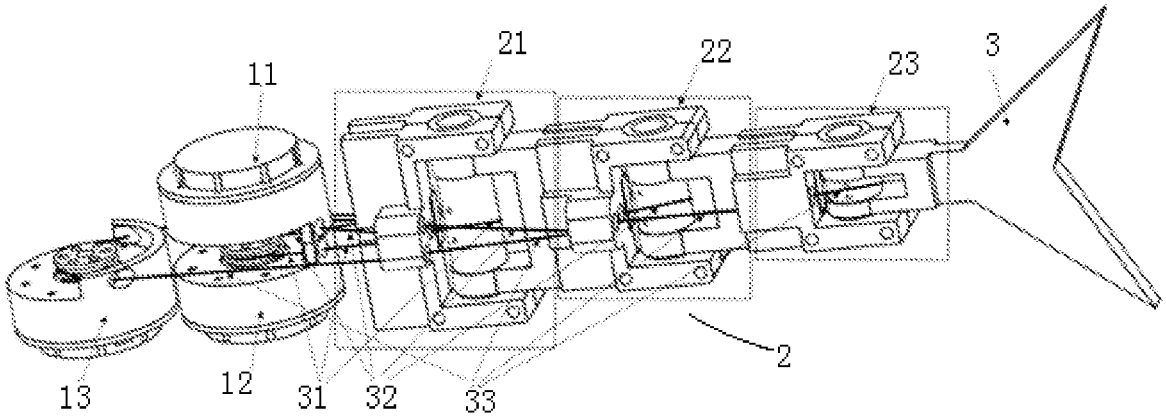
FIG. 3 is a structural sectional view of a biomimetic underwater vehicle according to embodiments of the present disclosure.

Embodiments of the present disclosure provide a biomimetic underwater vehicle, which is mainly used for navigation in water. As shown in FIGS. 1-3, the biomimetic underwater vehicle comprises a head portion 1 and a body portion 2, wherein the head portion 1 is located at the front of the biomimetic underwater vehicle, and comprises a first housing 10, a motor portion is provided in the first housing 10; the motor portion comprises at least one motor assembly, and in the present embodiment, the motor portion comprises a first motor assembly 11, a second motor assembly 12 and a third motor assembly 13; preferably, the third motor assembly 13 is located at the front of the head portion 1, and the first motor assembly 11 and the second motor assembly 12 are attached to each other and located at the rear of the head portion 1.

The body portion 2 comprises a second housing, at least one rotation joint is provided in the second housing, and each rotation joint corresponds to the motor assembly on one-to-one basis, and in the present embodiment, a first rotation joint 21, a second rotation joint 22 and a third rotation joint 23 are provided in the second housing; wherein the first rotation joint 21, the second rotation joint 22 and the third rotation joint 23 are sequentially connected in a length direction of the biomimetic underwater vehicle, and the third rotation joint 23 is connected to a tail portion 3.

Further, each motor assembly is connected to the corresponding rotation joint via at least two pull ropes and drives the rotation joint to move, and the two pull ropes are located on two sides of the body portion respectively. In this embodiment, the first motor assembly 11 is connected to the first rotation joint 21 via two first pull ropes 31 and drives the first rotation joint 21 to move; the second motor assembly 12 is connected to the second rotation joint 22 via two second pull ropes 32 and drives the second rotation joint 22 to move; and the third motor assembly 13 is connected to the third rotation joint 23 via two third pull ropes 33 and drives the third rotation joint 23 to move.

Further, the first motor assembly 11, the second motor assembly 12 and the third motor assembly 13 have substantially the same structure, and first the third motor assembly 13 will be taken as an example for illustrating the specific structure of the motor assembly.

Figure 4:
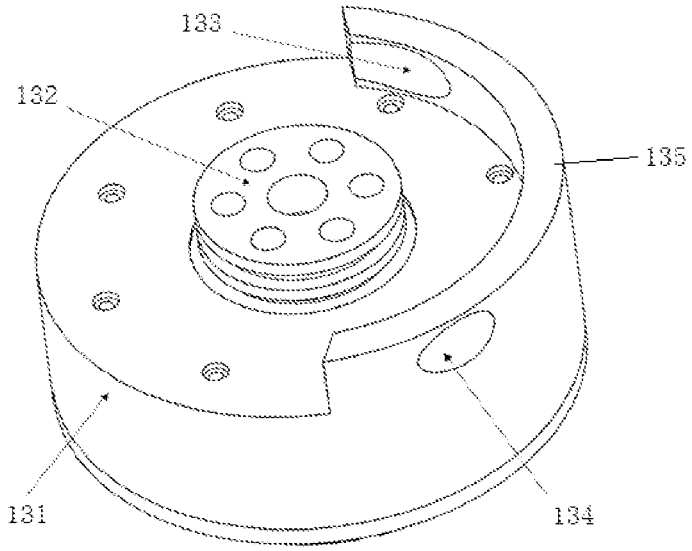
FIG. 4 is a schematic structural diagram of a third motor assembly in a wheel-biomimetic underwater vehicle according to embodiments of the present disclosure.

As shown in FIG. 4, the third motor assembly 13 comprises a third motor 131, a third cable reel 132 is sleeved on an output shaft of the third motor 131, and the third cable reel 132 rotates along with the output shaft of the third motor 131; a third protrusion portion 135 is provided on an end face of an output side of the third motor 131, and the third protrusion portion 135 may be separately provided on an end face of the third motor 131, and may also be integrally formed with an outer housing of the third motor 131; and the third protrusion portion 135 is provided with a first connecting hole 133 and a second connecting hole 134. As the third motor assembly 13 is connected to the third rotation joint 23 via the third pull ropes 33 and drives the third rotation joint 23 to move, the third pull ropes 33 are sleeved on the third cable reel 132, and two ends, i.e. one end of a third pull rope 33 and one end of the other third pull rope respectively pass through the first connecting hole 133 and the second connecting hole 134 and then are connected to the third rotation joint 23 located in the body portion 2.

Likewise, with reference to the structure of the third motor assembly 13, the first motor assembly 11 comprises a first motor, a first cable reel is sleeved on an output shaft of the first motor, and the first cable reel rotates along with the output shaft of the first motor; a first protrusion portion is provided on an end face of an output side of the first motor, and the first protrusion portion may be separately provided on an end face of the first motor, and may also be integrally formed with an outer housing of the first motor; and the first protrusion portion is provided with a third connecting hole and a fourth connecting hole. As the first motor assembly 11 is connected to the first rotation joint 21 via the first pull ropes 31 and drives the first rotation joint 21 to move, the first pull ropes 31 are sleeved on the first cable reel, and two ends, i.e. one end of a first pull rope 31 and one end of the other first pull rope respectively pass through the third connecting hole and the fourth connecting hole and then are connected to the first rotation joint 21 located in the body portion 2.

Likewise, with reference to the structure of the third motor assembly 13, the second motor assembly 12 comprises a second motor, a second cable reel is sleeved on an output shaft of the second motor, and the second cable reel rotates along with the output shaft of the second motor; a second protrusion portion is provided on an end face of an output side of the second motor, and the second protrusion portion may be separately provided on an end face of the second motor, and may also be integrally formed with an outer housing of the second motor; and the second protrusion portion is provided with a fifth connecting hole and a sixth connecting hole. As the second motor assembly 12 is connected to the second rotation joint 22 via the second pull ropes 32 and drives the second rotation joint 22 to move, the second pull ropes 32 are sleeved on the second cable reel, and two ends, i.e. one end of a second pull rope 32 and one end of the other second pull rope respectively pass through the fifth connecting hole and the sixth connecting hole and then are connected to the second rotation joint 22 located in the body portion 2.

Figure 5:
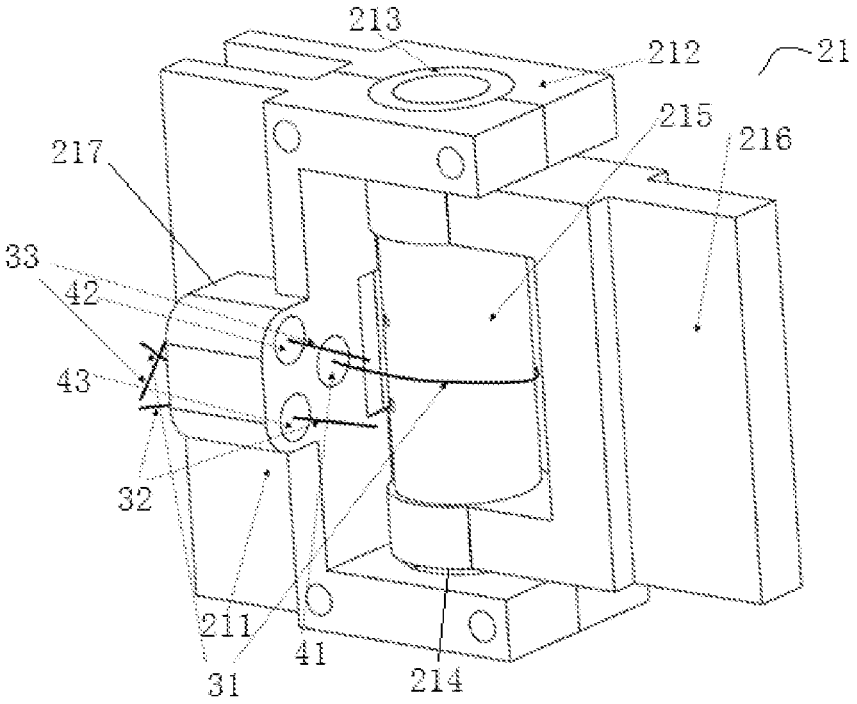
FIG. 5 is a schematic structural diagram of a first rotation joint in a wheel-biomimetic underwater vehicle according to embodiments of the present disclosure.
Figure 6:
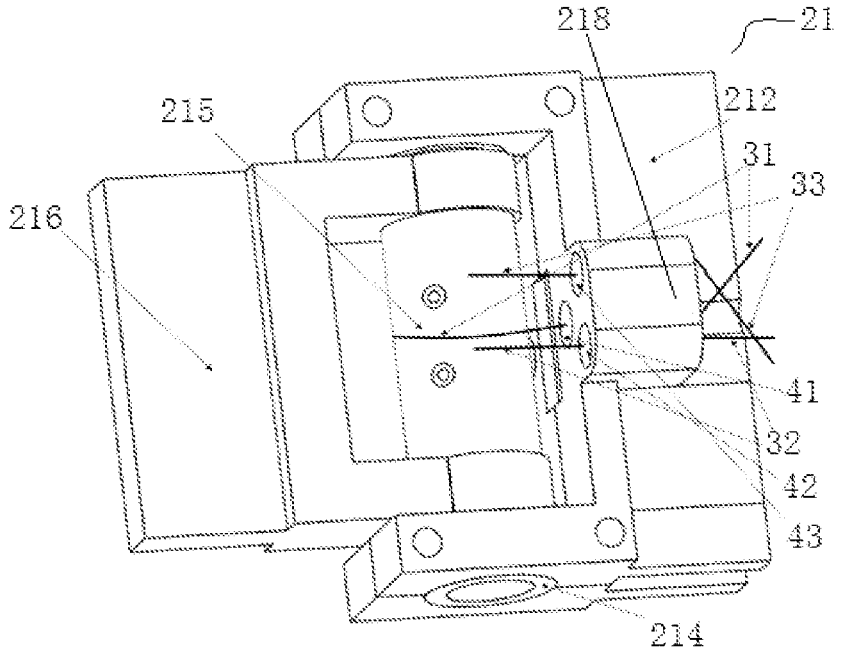
FIG. 6 is a schematic structural diagram of a first rotation joint in a wheel-biomimetic underwater vehicle according to embodiments of the present disclosure.

Further, as shown in FIGS. 5 and 6, FIGS. 5 and 6 respectively show the structure of the first rotation joint 21 from two directions. The first rotation joint 21 comprises a first base 211 and a second base 212 which are both U-shaped, and the first base 211 and the second base 212 can be assembled with each other to form a first base portion; a long edge located on one side of the first base 211 and a long edge located on the same side of the second base 212 are assembled with each other to form a first bearing 213, and a long edge located on the other side of the first base 211 and a long edge located on the same side of the second base 212 are assembled with each other to form a second bearing 214, wherein the first bearing 213 and the second bearing 214 are provided opposite to each other, and a first joint rotation shaft 215 is provided between the first bearing 213 and the second bearing 214, the first joint rotation shaft 215 can rotate between the first bearing 213 and the second bearing 214; and a first joint connecting member 216 is sleeved on the first joint rotation shaft 215, and the first joint connecting member 216 is used for connecting to the second rotation joint 22. In addition, a first pull rope restraint portion 217 and a second pull rope restraint portion 218 are respectively provided on short edges of the first base 211 and the second base 212, the first pull rope restraint portion 217 and the second pull rope restraint portion 218 respectively protrude from end faces of the first base 211 and the second base 212, and each of the first pull rope restraint portion 217 and the second pull rope restraint portion 218 is provided with three through holes, which are respectively a first fixing hole 41, a first restraint hole 42, and a second restraint hole 43; wherein the first fixing hole 41 is arranged near the first base 211 and the second base 212, and the first restraint hole 42 and the second restraint hole 43 are arranged near the outer side of the first pull rope restraint portion 217 or the second pull rope restraint portion 218.

Figure 7:
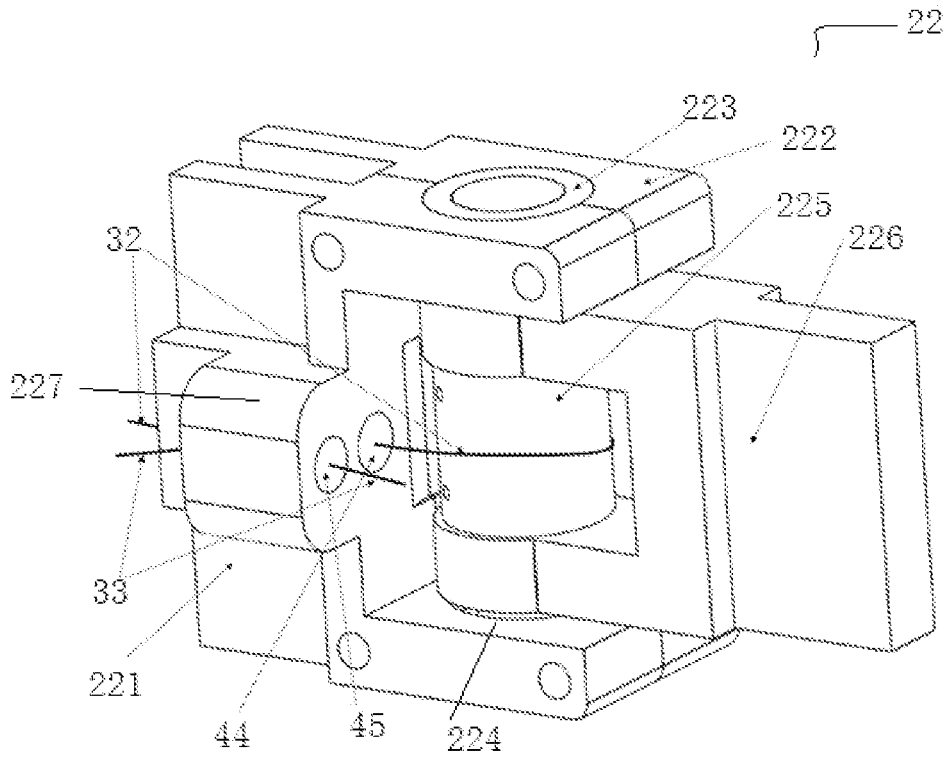
FIG. 7 is a schematic structural diagram of a second rotation joint in a wheel-biomimetic underwater vehicle according to embodiments of the present disclosure.
Figure 8:
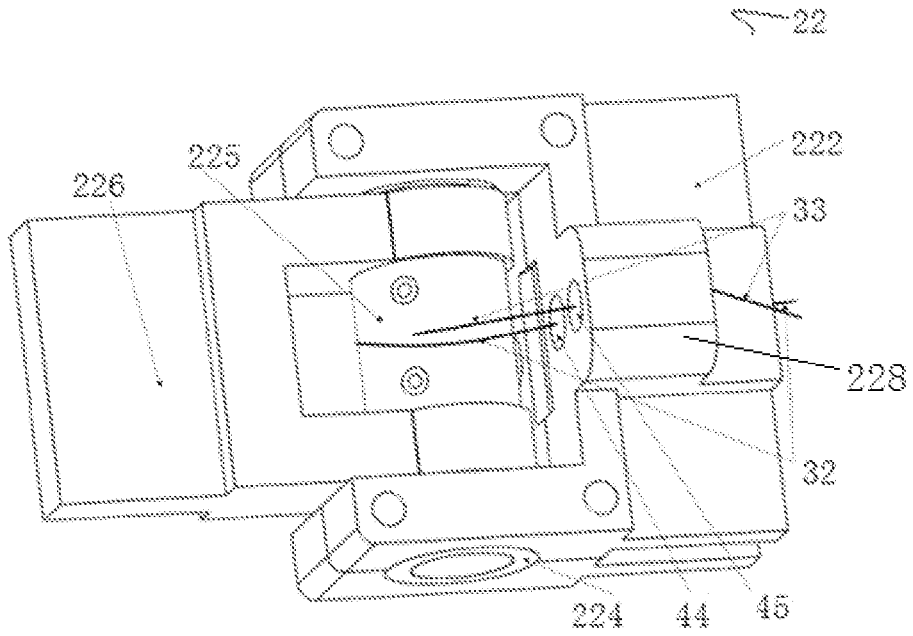
FIG. 8 is a schematic structural diagram of a second rotation joint in a wheel-biomimetic underwater vehicle according to embodiments of the present disclosure.

Further, as shown in FIGS. 7 and 8, FIGS. 7 and 8 respectively show the structure of the second rotation joint 22 from two directions. The second rotation joint 22 comprises a third base 221 and a fourth base 222 which are both U-shaped, and the third base 221 and the fourth base 222 can be assembled with each other to form a second base portion; wherein the first joint connecting member 216 is movably connected to the second base portion; a long edge located at one side of the third base 221 and a long edge located at the same side of the fourth base 222 are assembled with each other to form a third bearing 223, and a long edge located on the other side of the third base 221 and a long edge located on the same side of the fourth base 222 are assembled with each other to form a fourth bearing 224, wherein the third bearing 223 and the fourth bearing 224 are provided opposite to each other, and a second joint rotation shaft 225 is provided between the third bearing 223 and the fourth bearing 224, the second joint rotation shaft 225 can rotate between the third bearing 223 and the fourth bearing 224; and a second joint connecting member 226 is sleeved on the second joint rotation shaft 225, and the second joint connecting member 226 is used for connecting to the third rotation joint 23. In addition, a third pull rope restraint portion 227 and a fourth pull rope restraint portion 228 are respectively provided on short edges of the third base 221 and the fourth base 222, the third pull rope restraint portion 227 and the fourth pull rope restraint portion 228 respectively protrude from end faces of the third base 221 and the fourth base 222, and each of the third pull rope restraint portion 227 and the fourth pull rope restraint portion 228 is provided with two through holes, which are respectively a second fixing hole 44 and a third restraint hole 45; wherein the second fixing hole 44 is arranged near the third base 221 and the fourth base 222, and the third restraint hole 45 is arranged near the outer side of the third pull rope restraint portion 227 or the fourth pull rope restraint portion 228, respectively.

Figure 9:
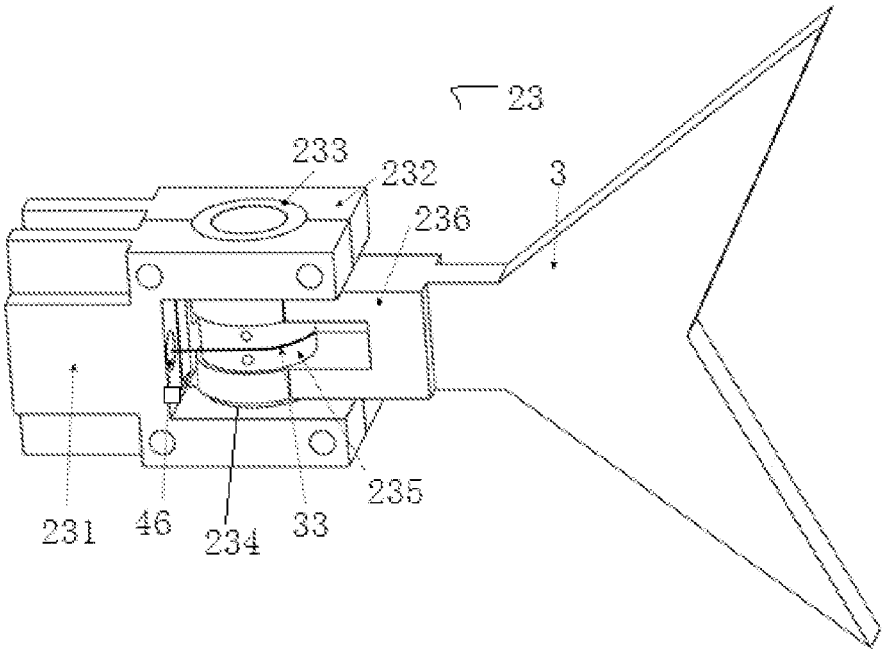
FIG. 9 is a schematic structural diagram of a third rotation joint in a wheel-biomimetic underwater vehicle according to embodiments of the present disclosure.
Figure 10:
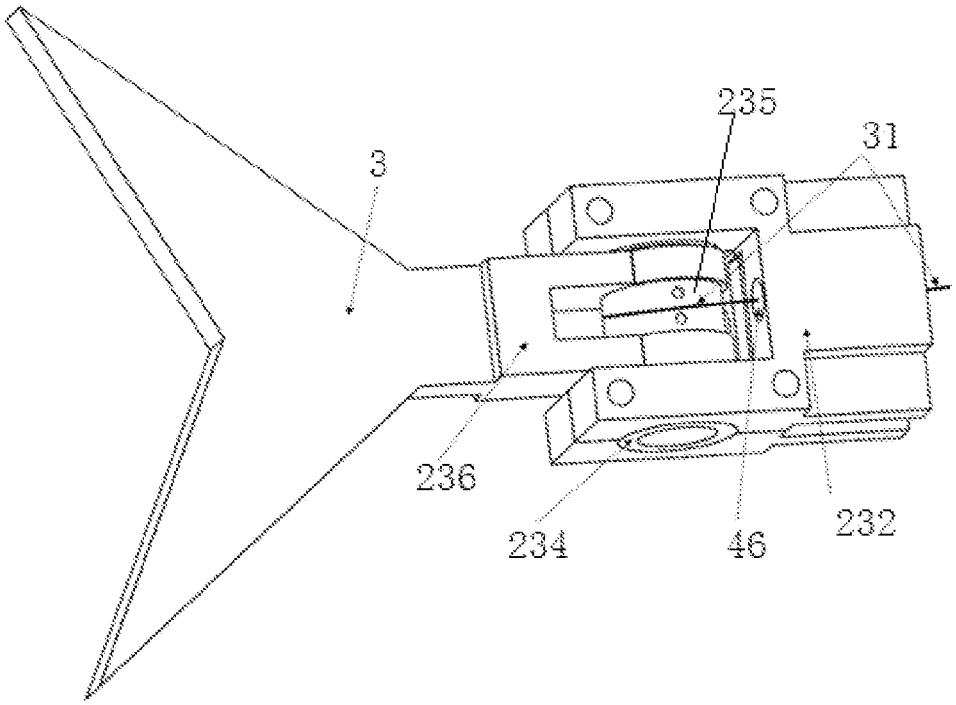
FIG. 10 is a schematic structural diagram of a third rotation joint in a wheel-biomimetic underwater vehicle according to embodiments of the present disclosure.

Further, as shown in FIGS. 9 and 10, FIGS. 9 and 10 respectively show the structure of the third rotation joint 23 from two directions. The third rotation joint 23 comprises a fifth base 231 and a sixth base 232 which are both U-shaped, and the fifth base 231 and the sixth base 232 can be assembled with each other to form a third base portion; wherein the second joint connecting member 226 is movably connected to the third base portion; a long edge located on one side of the fifth base 231 and a long edge located on the same side of the sixth base 232 are assembled with each other to form a fifth bearing 233, and a long edge located on the other side of the fifth base 231 and a long edge located on the same side of the sixth base 232 are assembled with each other to form a sixth bearing 234, wherein the fifth bearing 233 and the sixth bearing 234 are provided opposite to each other, and a third joint rotation shaft 235 is provided between the fifth bearing 233 and the sixth bearing 234, the third joint rotation shaft 235 can rotate between the fifth bearing 233 and the sixth bearing 234; and a third joint connecting member 236 is sleeved on the third joint rotation shaft 235, and the third joint connecting member 236 is used for connecting to the tail portion 3. In addition, a through hole is provided on each of the short edges of the fifth base 231 and the sixth base 232, and the through hole is a third fixing hole 46.

As described above, the first motor assembly 11 is connected to the first rotation joint 21 via the first pull ropes 31 and drives the first rotation joint 21 to move, wherein the first pull ropes 31 are sleeved on the first cable reel on the first motor, and two ends, i.e. one end of a first pull rope and one end of the other first pull rope respectively pass through the third connecting hole 113 and the fourth connecting hole on the first protrusion portion on the first motor, and respectively pass through the first fixing holes 41 on the first rotation joint 21, so as to be sleeved on the first joint rotation shaft 215 on the first rotation joint 21.

By the same reasoning, the second motor assembly 12 is connected to the second rotation joint 22 via the second pull ropes 32 and drives the second rotation joint 22 to move, wherein the second pull ropes 32 are sleeved on the second cable reel 122 of the second motor 121, and two ends, i.e. one end of a second pull rope and one end of the other second pull rope respectively pass through the fifth connecting hole 123 and the sixth connecting hole 124 on the second protrusion portion 125 of the second motor 121, and respectively pass through the first restraint holes 42 on the first rotation joint 21 and the second fixing holes 44 on the second rotation joint 22, so as to be sleeved on the second joint rotation shaft 225 of the second rotation joint 22.

By the same reasoning, the third motor assembly 13 is connected to the third rotation joint 23 via the third pull ropes 33 and drives the third rotation joint 23 to move, wherein the third pull ropes 33 are sleeved on the third cable reel 132 on the third motor 131, and two ends, i.e. one end of a third pull rope and one end of the other third pull rope respectively pass through the first connecting hole 133 and the second connecting hole 134 of the third protrusion portion 135 on the third motor 131, and respectively pass through the second restraint holes 43 on the first rotation joint 21 and the third restraint holes 45 on the second rotation joint 22, and finally pass through the third fixing holes 46 on the third rotation joint 23, so as to be sleeved on the third joint rotation shaft 235 of the third rotation joint 23.

Figure 11:
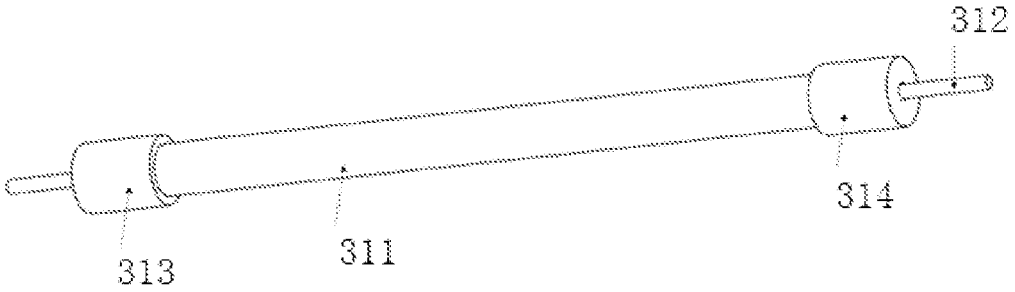
FIG. 11 is a schematic structural diagram of a first pull rope in a wheel-biomimetic underwater vehicle according to embodiments of the present disclosure.

Further, as shown in FIG. 11, the first pull ropes 31, the second pull ropes 32 and the third pull ropes 33 have the same structure, and the first pull rope 31 will be taken as an example for illustrating the specific structure of the pull ropes. The first pull rope 31 comprises a first cable tube 311 and a first cable 312, wherein a first cable tube cap 313 and a second cable tube cap 314 are respectively provided at two ends of the first cable tube 311, and the first cable 312 passes through the first cable tube 311. The first cable tube caps 313 of the two first pull ropes 31 located at two sides are respectively fixed in the third connecting hole and the fourth connecting hole, and the second cable tube caps of the two first pull ropes 31 are respectively fixed in the two first fixing holes 41 of the first base, and thus the first cables 312 can move freely in the first cable tubes 311.

By the same reasoning, each second pull rope 32 comprises a second cable tube and a second cable, wherein a third cable tube cap and a fourth cable tube cap are respectively arranged at two ends of the second cable tube, and the second cable passes through the second cable tube; wherein the third cable tube caps of the two second pull ropes 32 located at two sides are respectively fixed in the fifth connecting hole and the sixth connecting hole, and the fourth cable tube caps of the two second pull ropes 32 are respectively fixed in the two second fixing holes 44 of the second base, so that the second cables can move freely in the second cable tubes.

Each third pull rope 33 comprises a third cable tube and a third cable, wherein a fifth cable tube cap and a sixth cable tube cap are respectively provided at two ends of the third cable tube, and the third cable passes through the third cable tube, wherein the fifth cable tube caps of the two third pull ropes 33 located at two sides are respectively fixed in the first connecting hole and the second connecting hole, and the sixth cable tube caps of the two third pull ropes 33 are respectively fixed in the two third fixing holes 46 of the third base, so that the third cables can move freely in the third cable tubes.

In this way, each of the cable tubes herein ensures that the pull rope structures can adapt to, for example, the deformation motion of a joint of the tail portion 3; the cables in the cable tubes can freely slide inside the cable tubes, so that the motion of the driving motor is accurately transferred to the rotation shaft on each rotation joint, thereby implementing accurate control of the rotation shaft.

In the embodiments of the present disclosure, the movements of the joints in the body portion and the tail portion of the biomimetic underwater vehicle are driven by the motor portion as a driving device located in the head portion 1. Specifically, the first motor assembly 11, the second motor assembly 12 and the third motor assembly 13 independently drive the movement of the first rotation joint 21, the second rotation joint 22 and the third rotation joint 23 via the first pull ropes 31, the second pull ropes 32 and the third pull ropes 33, respectively, thereby allowing for the biomimetic underwater vehicle to simulate the swinging of fish, for example.

According to the embodiments of the present disclosure, by the corresponding arrangements of the motors located at the head portion and the rotation joints located in the middle and the transmission manner of multiple joints, on the one hand, the inertia of movement of the tail portion of the biomimetic underwater vehicle is reduced, and on the other hand, the center of gravity of the whole is moved forward so as to reduce the swinging movement of the head portion during driving of the biomimetic underwater vehicle, thereby achieving a flexible biomimetic effect and improving the propulsive performance of the biomimetic underwater vehicle.

The description above is only illustration about the preferred embodiments of the present disclosure and technical principles adopted. A person skilled in the art should understand that the scope of disclosure involved in the present disclosure is not limited to the technical solutions formed by specifically combining the technical features and should also cover other technical solutions formed by arbitrarily combining the technical features or equivalent features thereof without departing from the inventive concept. For example, technical solutions formed by mutually replacing the features and (but not limited to) the technical features with similar functions disclosed in the present disclosure.

Although the subject matter has been described in language specific to structural features and/or methodological logic acts, it should be understood that the subject matter defined in the appended claims is not necessarily limited to the specific features or acts described above. Rather, the specific features and acts described above are merely exemplary forms for implementing the claims.

Hereinabove, a plurality of embodiments of the present disclosure have been described in detail, but the present disclosure is not limited to these specific embodiments. On the basis of the concept of the present disclosure, a person skilled in the art could make various variations and modifications, and these variations and modifications shall fall within the scope of protection of the present disclosure.

What is claimed is:

1. A biomimetic underwater vehicle, comprising a head portion and a body portion, wherein the head portion comprises a first housing, a motor portion is provided in the first housing, the motor portion comprises a plurality of motor assemblies; the body portion comprises a second housing, and a plurality of rotation joints corresponding to the plurality of motor assemblies are provided in the second housing; the plurality of rotation joints are sequentially connected along the length direction of the biomimetic underwater vehicle, and the rotation joint at the most downstream is connected to a tail portion, and each of the motor assemblies is connected to the corresponding rotation joint via at least two pull ropes and drives the rotation joint to move, and the two pull ropes are located on two sides of the body portion respectively;

wherein each of the rotation joints comprises a first base and a second base which are both U-shaped, wherein the first base and the second base are assembled with each other to form a base portion, a long edge located on one side of the first base and a long edge located on the same side of the second base are assembled with each other to form a first bearing, and a long edge located on the other side of the first base and a long edge located on the same side of the second base are assembled with each other to form a second bearing, wherein the first bearing and the second bearing are provided opposite to each other, and a joint rotation shaft is provided between the first bearing and the second bearing, and the joint rotation shaft rotates between the first bearing and the second bearing;

wherein a joint connecting member is sleeved on the joint rotation shaft, and the joint connecting member is used for connecting to an adjacent rotation joint located downstream or connecting to the tail portion;

wherein a first pull rope restraint portion and a second pull rope restraint portion are respectively provided on short edges of the first base and the second base, the first pull rope restraint portion and the second pull rope restraint portion respectively protrude from end faces of the first base and the second base, and each of the first pull rope restraint portion and the second pull rope restraint portion is provided with a plurality of through holes, the through holes being used for fixing or restraining the pull ropes.

2. The biomimetic underwater vehicle according to claim 1, wherein the number of the motor assemblies or the rotation joints is three.

3. The biomimetic underwater vehicle according to claim 1, wherein each motor assembly comprises a motor, a cable reel is sleeved on an output shaft of the motor, a first end of each of the two pull ropes is sleeved on the cable reel, and a second end of each of the two pull ropes is connected to the corresponding rotation joint.

4. The biomimetic underwater vehicle according to claim 3, wherein a protrusion portion is provided on an end face of an output side of the motor, a first connecting hole and a second connecting hole are provided on the protrusion portion, and the second ends of the two pull ropes respectively pass through the first connecting hole and the second connecting hole and are connected to the corresponding rotation joint.

5. The biomimetic underwater vehicle according to claim 3, wherein the second ends of the pull ropes are sleeved on the joint rotation shaft.

6. The biomimetic underwater vehicle according to claim 3, wherein at least one through hole is provided on each of the short edges of the first base and the second base, and the through hole is used for fixing or restraining the pull ropes.

7. The biomimetic underwater vehicle according to claim 6, wherein each of the pull ropes comprises a cable tube and a cable, wherein a first cable tube cap and a second cable tube cap are respectively arranged at two ends of the cable tube, the cable passes through the cable tube and freely moves in the cable tube, and the first cable tube cap and the second cable tube cap are fixed in specified through holes.

* * * * *